US007819449B2

(12) United States Patent
Johnson

(10) Patent No.: US 7,819,449 B2
(45) Date of Patent: Oct. 26, 2010

(54) HANDGRIP FOR CARRYING MULTIPLE BAGS

(76) Inventor: Forrest Johnson, 232 - 9458 Prince Charles Boulevard, Surrey, British Columbia (CA) V3V 1S6

( * ) Notice: Subject to any disclaimer, the term of this patent is extended or adjusted under 35 U.S.C. 154(b) by 0 days.

(21) Appl. No.: 12/146,206

(22) Filed: Jun. 25, 2008

(65) Prior Publication Data

US 2008/0315599 A1 Dec. 25, 2008

Related U.S. Application Data

(60) Provisional application No. 60/929,357, filed on Jun. 25, 2007.

(51) Int. Cl.
*A45F 5/00* (2006.01)
*B65D 33/06* (2006.01)

(52) U.S. Cl. ..... 294/171; 294/137

(58) Field of Classification Search ..... 294/171, 294/1.1, 137; 248/99–101
See application file for complete search history.

(56) References Cited

U.S. PATENT DOCUMENTS

| | | | | |
|---|---|---|---|---|
| 3,913,172 | A | 10/1975 | Richards et al. | |
| 5,005,891 | A | 4/1991 | Lunsford | |
| 5,199,758 | A | 4/1993 | Howell | |
| 5,257,845 | A | 11/1993 | McConnell | |
| 5,487,582 | A * | 1/1996 | Bourgeois et al. | 294/146 |
| 5,511,445 | A * | 4/1996 | Hildebrandt | 74/558.5 |
| 5,722,117 | A | 3/1998 | Nielsen | |
| 5,803,522 | A * | 9/1998 | Lisbon | 294/171 |
| 6,354,645 | B2 * | 3/2002 | Bozlee | 294/171 |
| 6,494,619 | B1 * | 12/2002 | Sulpizio | 248/99 |

FOREIGN PATENT DOCUMENTS

| | | | |
|---|---|---|---|
| CA | 2197418 | * | 5/1998 |
| CA | 2359378 | | 4/2003 |
| DE | 3347410 | * | 7/1985 |
| DE | 3509679 | * | 9/1986 |

* cited by examiner

*Primary Examiner*—Paul T Chin
(74) *Attorney, Agent, or Firm*—Smiths IP; Lawrence Chan

(57) ABSTRACT

An attachable and detachable handgrip, primarily used with plastic bags, canvas bags and other items with handles, is disclosed. The attachable handgrip comprises a single piece of flat, pliable material that will hold its shape, yet yield easily to force.

The material is rolled upon itself to form a spiral structure. Once formed, the handgrip is attached to the bag handles by placing the bag handles in the longitudinal slit formed along an edge of the spiral structure and rotating the spiral structure until the bag handles are within the spiral structure.

7 Claims, 4 Drawing Sheets

HANDGRIP FOR CARRYING MULTIPLE BAGS

RELATED APPLICATIONS

This application claims priority from U.S. Provisional Patent Application Ser. No. 60/929,357 filed Jun. 25, 2007, which is hereby incorporated by reference.

FIELD OF INVENTION

This invention relates to handgrips for objects with handles, such as plastic bags.

BACKGROUND OF THE INVENTION

Various problems arise when transporting goods with handles or in bags with handles, such as plastic shopping bags. When carrying a heavy load by hand, the weight tends to pull the plastic shopping bag handles into a tight bunch that places most of the weight of the load on a thin line across the fingers or palm of the hand, resulting in discomfort.

When carrying a lot of bags by hand, putting them down and picking them up becomes time-consuming because the plastic bag handles often separate and the items inside spill over and/or fall out of the bags. Once the items are placed back in the bags, the bag handles must be gathered together before picking the bags up or the bags must be picked up one at a time. These problems are exasperated when transporting goods in plastic shopping bags in a vehicle.

Several different types of handgrips have been designed to try to address these problems.

U.S. Pat. No. 5,257,845 to McConnell discloses a detachable hand grip for carrying bags and the like that includes a flexible flat body having a slit extending from each end for receiving the flexible handles of a shopping bag.

U.S. Pat. No. 5,199,758 to Howell discloses a rigid carrier apparatus for carrying packages formed in the configuration of a tubular body having opposite ends and a slot for spiraling through the body between the opposite ends.

U.S. Pat. No. 5,005,891 to Lunsford discloses a bag handle apparatus comprising a thin sheet of semi-rigid flexible material having a locking tab formed on one end, and a locking slot formed in a second end of the sheet. The locking tab engages the locking slot to hold the bag handle apparatus in a generally accurate shape about one or more bag handles.

U.S. Pat. No. 3,913,172 to Richards discloses an elongated block including a longitudinal channel therein opening outwardly of one longitudinal side of the block as well as its opposite ends. The channel may receive rope or equivalent shopping bag handles therein and a closure panel extending longitudinally of the block is provided for closing channel.

U.S. Pat. No. 5,722,177 to Nielsen discloses a spring-like split tubular device having overlapping longitudinal edges that close over the bag handles when placed inside the tubular device.

All of the above mentioned devices either employ a rigid material or, in the case of non-rigid materials, only provide one layer of material between the hand of the user and the handles of the bags or other items being carried. It is desirable to have a design that employs multiple layers of a non-rigid material that is less expensive. This also allows for the use of materials that have less of an environmental impact should the device be disposed of instead of reused or recycled.

Several examples available on the market today are cumbersome to carry in a purse or pocket because they are large in size and/or rigid. By employing a spiral design that can be rolled up tightly and then placed in a pocket or purse and then expanded again for use, the device becomes easier to transport.

Devices that are produced from rigid material have to include enough material for the user to comfortably grip as well as a space to accommodate the bag handles. This means that a lot of space is wasted once the device is packaged for storage and shipping. The spiral design of the device is therefore desirable because it allows for the device to be tightly rolled and secured by a band, or other means, for the purpose of taking up less space for both shipping and storage, and to take up less space at the point of sale until it reaches the end user.

Some handgrips are difficult to attach or remove. By employing a flexible material in the design, attaching and removing the handgrip is easy.

Several examples available on the market today are rigid and have to be made from material such as plastic which is difficult and expensive to print on. By employing a design that can be made from paperboard, which is easily and inexpensively printed on, retailers have a lower cost opportunity to advertise on the device.

Several examples available on the market today also create new problems for the user. They can be too heavy when putting the bags down so that the handgrip ends up inside the bags or on the ground next to the bags. By using a small amount of lightweight material, the rigidity of the bag handles is more likely to keep the attachable bag handle in a higher position.

Some handgrips are configured in a way that they have a top and bottom and end up being upside down and/or sometimes inside the bag when the bags are put down. By using a design that does not have a top or bottom, this problem is eliminated.

Shopping bag handgrips produced with moulded plastic are relatively expensive. Moreover the retail customer must keep the handgrips on their person if they wish to use them for spontaneous purchases. Often a retail customer will make enough purchases that they require both hands to carry the bags, thus doubling the expense should they choose to purchase handgrips. The disclosed design provides consumers and retailers with a low cost option.

Many consumers today are choosing reusable canvas bags. Shopping bag handles that are ridged in nature often don't fit the thicker handles of canvas bags. By employing a design using a flexible material that can be expanded at will, the consumer can use it on different sized bag handles.

SUMMARY OF THE INVENTION

An objective of this invention is to provide a solution to the discomfort of carrying a heavy load in plastic shopping bags and the inconveniences of picking up and putting down loaded shopping bags and transporting such bags in a vehicle. The invention also provides an option for users of canvas bags.

This is achieved by the user attaching the attachable handgrip by placing the loop handles of a single bag together (it helps to first give the loop handles a twist) and pulling the loop handles tight across the back of the thumb and pointer finger of one hand and simply rolling the attachable handgrip onto the loop handles until they reach the center of the spiral. The user can continue to add bags as they make purchases without removing the bags already attached by using this same technique. When attaching multiple bags to the handle, or thicker loop handles such as those found on canvas bags, the user can unroll the attachable handgrip and pinch it a short distance from the end that was in the centre of the roll forming a hook to place the loop handles on. Once all the handles are placed on the hook the user passes the other end through the loop handles and spins it to tighten the spiral until several layers of the attachable handle are between the user's hand and the bag loop handles.

Another objective is to provide retailers and consumers with a handgrip inexpensive enough to produce that it can be purchased whenever needed at the point of sale or even given away by the retailer.

In one aspect, the invention comprises an apparatus for carrying one or more items, where each of the items has a handle. The apparatus comprises a sheet having a first edge and a second edge. The first edge is rolled upon itself towards the second edge to form a spiral structure. The spiral structure comprises a longitudinal slit for receiving the handles of the bags, with the longitudinal slit extending along the length of the second edge.

The sheet may also comprise a longitudinal crimp proximal to the first edge. The sheet may be made of a pliable material, such as plastic or paperboard. The second edge may be rounded at its proximal and distal ends.

In another aspect, the invention comprises a sheet of flexible material having a first edge and a second edge. The sheet defines a generally tubular structure with a spiral cross-section. The sheet further comprises a longitudinal gap along the length of the second edge for receiving the handles.

In yet another aspect, the invention comprises a method for transporting one or more items, with each of the items having a handle. The method comprises providing a sheet having a first edge and a second edge. The first edge is rolled upon itself towards the second edge to form a spiral structure, with the spiral structure comprising a longitudinal slit extending along the length of the second edge. The handles are then placed in the longitudinal slit, and the spiral structure is rotated about the handles such that the handles are within the spiral structure.

The rotating of the spiral structure may be stopped when the handles are at the centre of the spiral structure.

In order to release the handles, the second edge may be unrolled away from the first edge until the sheet forms a generally planar configuration.

The particular objects of the invention will be better understood by reference to the detailed description of the preferred embodiment that follows.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof in which:

FIG. 6 shows the combination contest game piece and handgrip prior to being rolled up and sealed so that it cannot be tampered with.

DESCRIPTION OF THE PREFERRED EMBODIMENT OF THE INVENTION

Figure 1:
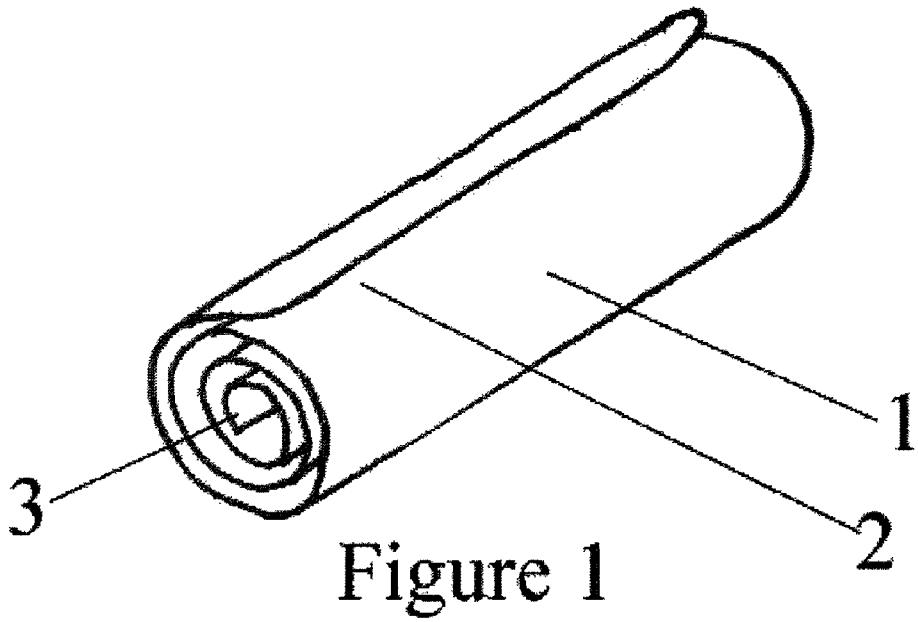
FIG. 1 is a perspective view of the handgrip according to the preferred embodiment of the present invention.
Figure 2:
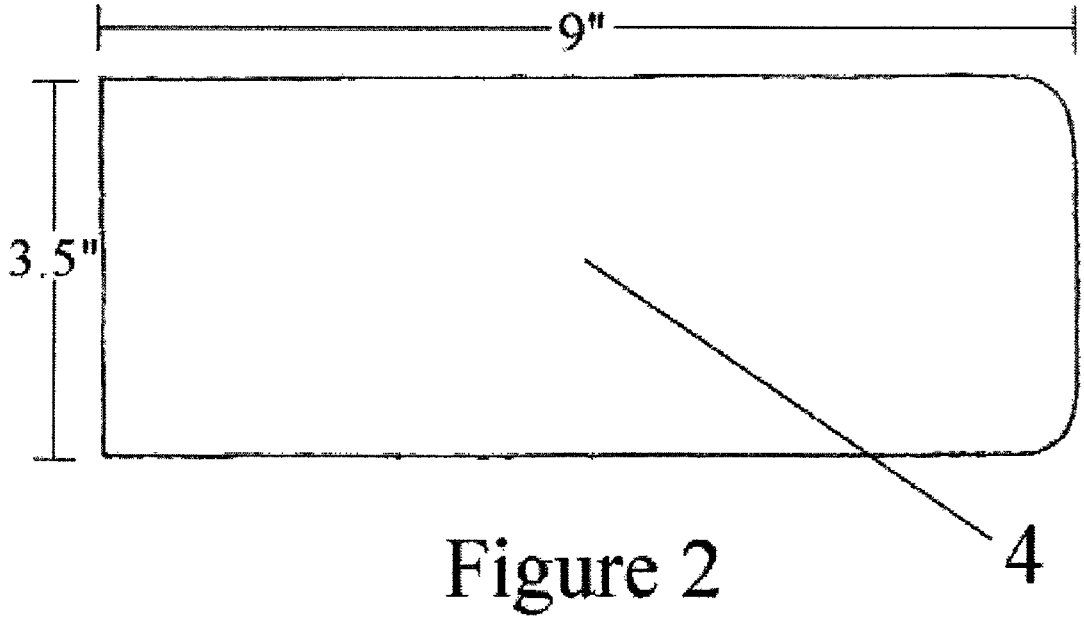
FIG. 2 is a view of the handgrip prior to being rolled up.

Referring now to the drawing shown in FIG. 1, an attachable (and detachable) handgrip 1 is disclosed, primarily for use with plastic shopping bags and other items with handles. The attachable handgrip 1 comprises a single piece of flat, pliable material that will hold its shape, yet yield easily to force as shown in FIG. 2. This material may be paperboard, plastic or any other with the same properties, and may be cut to a width suitable for the widest example within reason for the human hand, approximately 3.5 inches. The material may be cut at a length that makes it practical to roll the material into a spiral roll.

Figure 3:
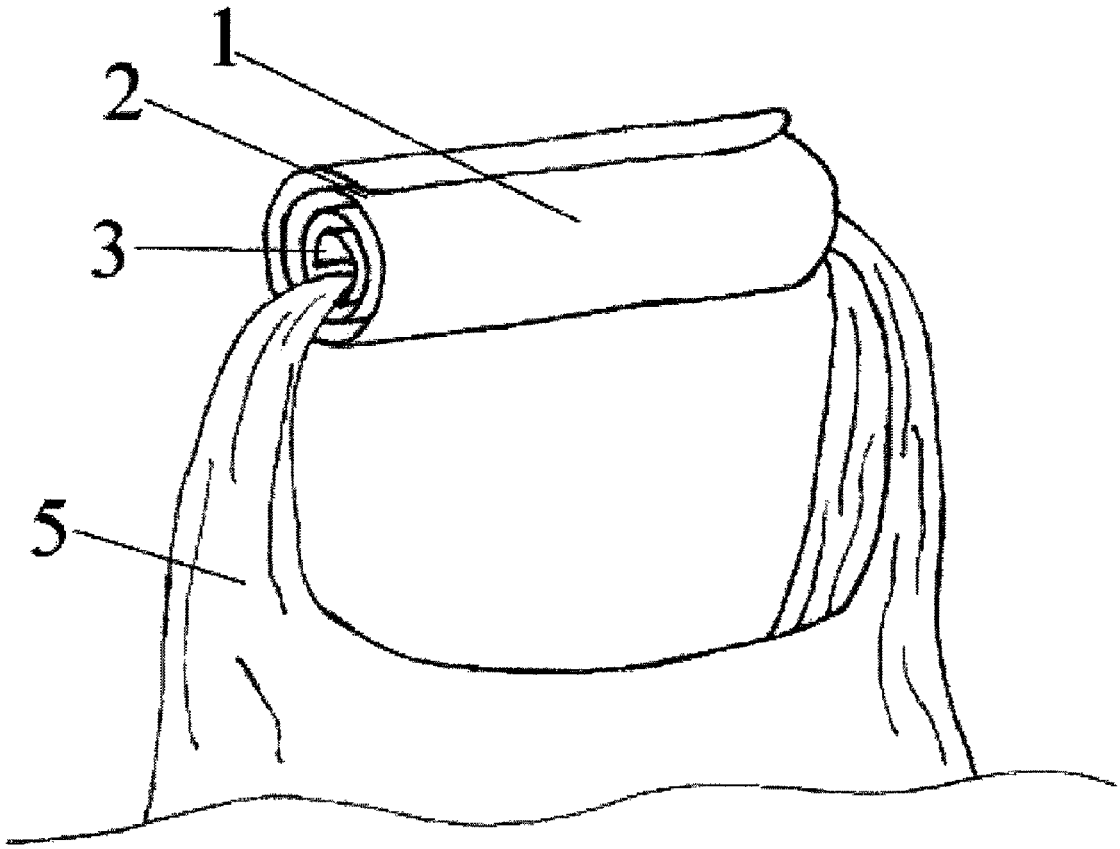
FIG. 3 shows the handgrip attached to the loop handles of plastic shopping bags.
Figure 4:
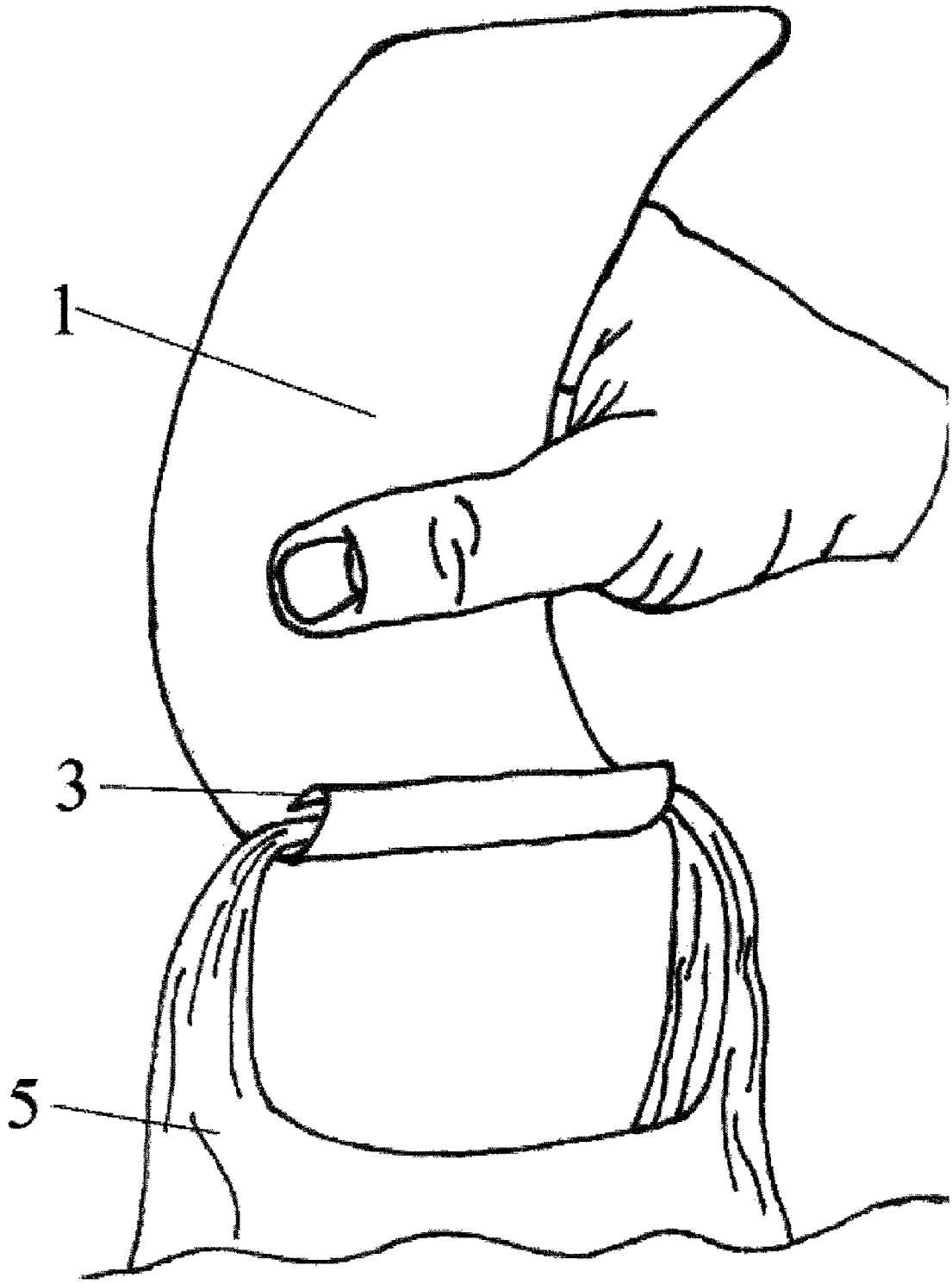
FIG. 4 shows the handgrip having been unrolled and gripped a short distance away from the inside end with the exaggerated curve so that bags can be placed on the hook that is formed.

As shown in FIG. 3, the space between the layers of the roll should be such that it practically accommodates the plastic bag loop handles 5. The user attaches the attachable hand grip 1 by placing the bag loop handles 5 of a single bag together (it helps to first give the loop handles 5 a twist) and pulling the bag loop handles 5 tight across the back of the thumb and pointer finger of one hand and simply rolling the attachable hand grip 1 onto the bag loop handles 5 until they reach the center of the spiral. When attaching multiple bags to the handle, or thicker loop handles such as those found on canvas bags, the user can unroll the attachable handgrip and pinch it a short distance from the end that was in the center of the roll forming a hook 3 to place the loop handles 4 on, as shown in FIG. 4. The forming of the hook 3 may be facilitated by a crimp located near the center of the roll. Once all the handles are placed on the hook the user passes the other end through the loop handles and spins it to tighten the spiral until several layers of the attachable handle are between the user's hand and the bag loop handles.

Once in this position, the loop handles 5 will be held together in the centre of the spiral and the bag openings will be facing upright. The user can now put down and pick up the bag(s) with one simple grabbing motion instead of having to gather several loose bag loop handles 5. By securing the loop handles 5 of the bag(s) together, it will be less likely to have the bag(s) fall over or have the contents spill out. The user can now transport the entire load in a vehicle with less likelihood of a bag falling over or contents spilling out.

Once the user picks up the entire load, the layers of the material that comprise the handgrip 1 will stack up (or compress) on each other to add rigidity and strength. This creates a comfortable, round handgrip 1. The user can now carry several bags, or a single bag of greater weight, a further distance.

The bag(s) may be removed from the handgrip 1 by spinning the handgrip 1 such that the loop handles 5 move away from the center of the spiral of the handgrip 1 towards the outside edge until the loop handles 5 slip off the handgrip 1. The bag(s) may also be removed by simply pulling firmly on the exposed outer flap of the spiral of the handgrip 1 such that the handgrip 1 unrolls around the loop handles 5 and springs off. Finally, the handgrip may simply be manually unrolled.

The simplicity of this idea opens up several other possibilities.

Instead of being individually produced, the appropriate material could come on a roll and be dispensed at the point of purchase. This could be done by the use of a dispenser similar to a desktop office tape dispenser, by employing rollers and/or scrapers to assist the curl of the material into the handgrip 1 configuration or a configuration that is easily manipulated into the handgrip 1. This could also be done by a cash register that can dispense a standard receipt or a receipt comprising the appropriate material in the handgrip 1 configuration or a configuration that is easily manipulated into the handgrip 1. Advertising could also be printed on the appropriate material.

Figure 5:
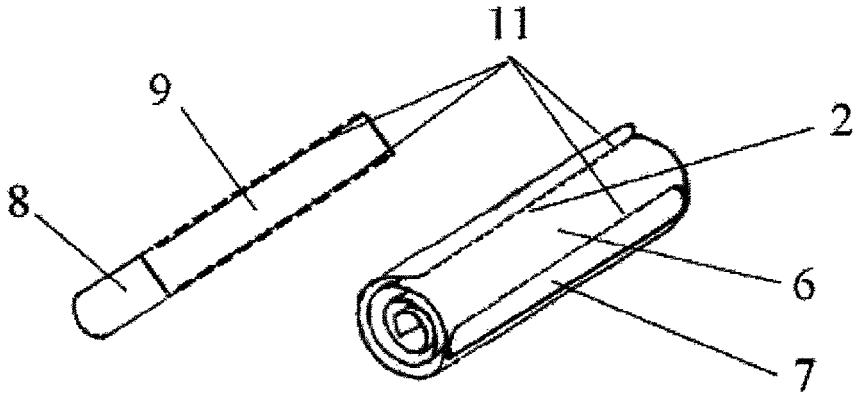
FIG. 5 shows one possible configuration of the combination contest game piece and handgrip.
Figure 6:
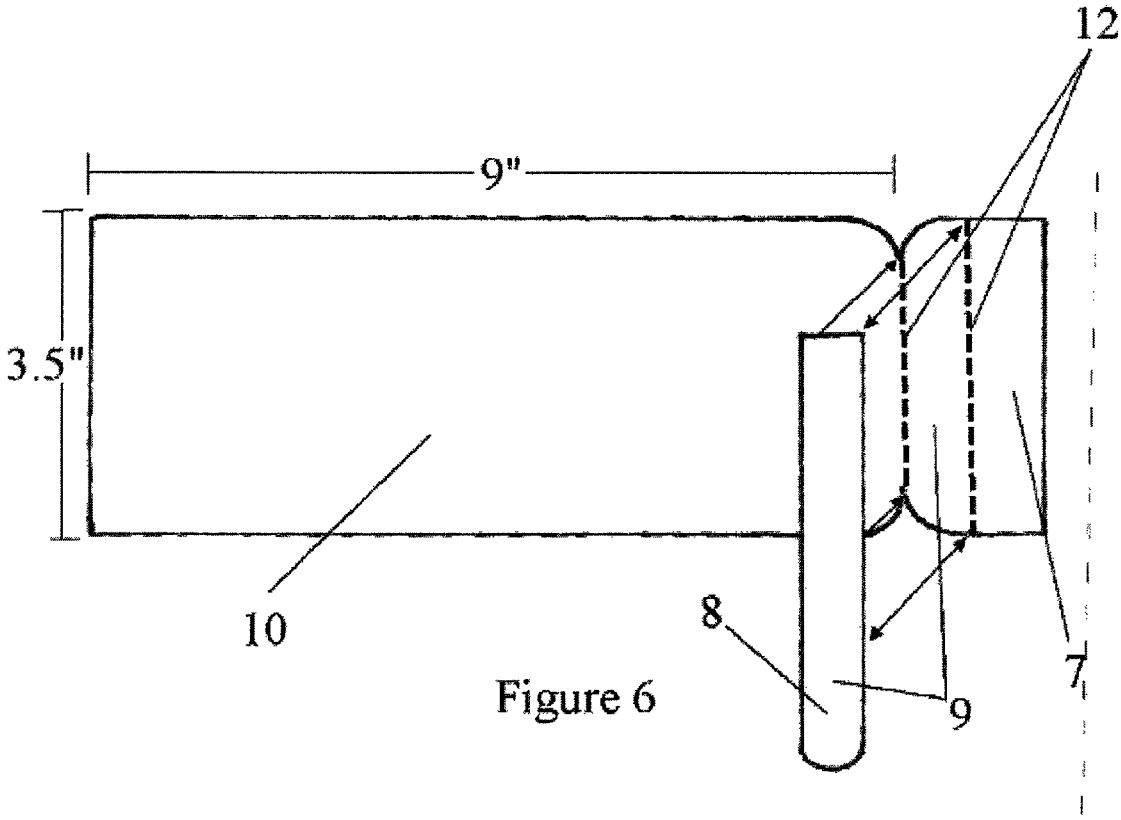

It is also possible to produce a combination contest game piece and handgrip 6 as shown in FIGS. 5 and 6. This is accomplished by ensuring that a tightly rolled handgrip cannot be unrolled without disturbing a tamper-proof closure. The tamper-proof closure could comprise perforations 11, 12, or something wire-like embedded in the cardboard, or some sort of glue that allows it to be pulled open from a permanently attached piece of material 7. This attached piece of material 7 can remain on the very outermost roll of the combination contest game piece and handgrip 6, away from the opening 2 and not interfering with its operation. It may be approximately half an inch wide and the same length as the handgrip's width that it lies across. The contest game piece could then be printed or incorporated on the attached piece of material 7 and remain hidden until the handgrip is unrolled or pulled apart. A tear-off piece 9 comprising a reinforcement strip 8 may be attached by the perforations 11, 12 to the attached piece of material 7. The tear-off piece 9 may be removed by pulling the reinforcement strip 8 along the perforations 11, 12.

It will be appreciated by those skilled in the art that the preferred embodiment has been described in some detail but that certain modifications may be practiced without departing from the principles of the invention.

What is claimed:

1. An apparatus for carrying one or more items, each of said one or more items having a handle, the apparatus comprising:

a sheet having a first edge and a second edge, a longitudinal crimp proximal to said first edge for engaging said handles of said one or more items, wherein said first edge is adapted to be rolled upon itself towards said second edge, while said handles of said one or more items are engaged by said longitudinal crimp, to form a spiral structure with said first edge extending along the substantially central axis of said spiral structure, said spiral structure comprising a plurality of spiral turnings spaced apart from one another, and wherein the diameter of said spiral structure is decreased by increasing the number of said spiral turnings.

2. The apparatus of claim 1, wherein said sheet is made of a pliable material.

3. The apparatus of claim 2, wherein said pliable material is paperboard.

4. The apparatus of claim 1, wherein said second edge is rounded at its proximal and distal ends.

5. A method for transporting one or more items, each of said one or more items having a handle, the method comprising:

providing a flexible sheet having a first edge and a second edge, wherein said flexible sheet comprises a longitudinal crimp proximal to said first edge;

engaging said handles of said one or more items with said longitudinal crimp;

rolling said first edge upon itself, while said handles of said one or more items are engaged by said longitudinal crimp, towards said second edge to form a spiral structure with said first edge extending along the substantially central axis of said spiral structure, said spiral structure comprising a plurality of spiral turnings spaced apart from one another; and decreasing the diameter of said spiral structure by increasing the number of said spiral turnings.

6. The method of claim 5, further comprising the step of unrolling said second edge away from said first edge until said sheet forms a generally planar configuration to allow for release of said handles.

7. The method of claim 5, further comprising the step of pulling on said second edge while holding onto said handles of said one or more items to allow for release of said handles.

* * * * *